US006140624A

United States Patent [19]

Gilbert, Sr.

[11] Patent Number: 6,140,624

[45] Date of Patent: Oct. 31, 2000

[54] PYROLYTIC BORON NITRIDE RADIATION HEATER

[75] Inventor: Michael H. Gilbert, Sr., North Olmsted, Ohio

[73] Assignee: Advanced Ceramics Corporation, Lakeland, Ohio

[21] Appl. No.: 09/347,335

[22] Filed: Jul. 2, 1999

[51] Int. Cl.[7] ..... H05B 3/10

[52] U.S. Cl. ..... 219/553; 219/548; 219/552

[58] Field of Search ..... 219/443.1, 444.1, 219/449.1, 451.1, 468.1, 521, 540, 542, 543, 544, 546, 548, 552, 553, 385, 411; 392/407, 432, 435; 118/725, 728; 338/248, 249; 264/81

[56] References Cited

U.S. PATENT DOCUMENTS

| | | | |
|---|---|---|---|
| 3,152,006 | 10/1964 | Basche | 264/81 |
| 3,805,024 | 4/1974 | Joeckel et al. | 219/544 |
| 5,063,031 | 11/1991 | Sato | 118/725 |
| 5,336,324 | 8/1994 | Stall et al. | 118/725 |
| 5,343,022 | 8/1994 | Gilbert, Sr. et al. | 118/725 |
| 5,344,492 | 9/1994 | Sato et al. | 118/725 |
| 5,700,992 | 12/1997 | Honda et al. | 219/444.1 |
| 5,766,363 | 6/1998 | Mizuno et al. | 118/725 |
| 5,800,753 | 9/1998 | Donadio . | |
| 5,827,371 | 10/1998 | Columbo et al. . | |
| 5,830,277 | 11/1998 | Johnsgard et al. | 118/725 |
| 5,904,872 | 5/1999 | Arami et al. | 219/544 |

*Primary Examiner*—Teresa Walberg
*Assistant Examiner*—Fadi H. Dahbour
*Attorney, Agent, or Firm*—Anderson, Kill & Olick, P.C.

[57] ABSTRACT

A pyrolytic boron nitride radiation heating unit including a dielectric base of boron nitride, a heating element of pyrolytic graphite superimposed on the dielectric base, a first outer coating surrounding said heating element composed of pyrolytic boron nitride and a second outer coating surrounding said first outer coating and having an emmissivity above at least about 0.9 at a wave length of 1.55 microns. The second outer coating is preferably selected from the group consisting of silicon carbide and boron carbide.

2 Claims, 2 Drawing Sheets

PYROLYTIC BORON NITRIDE RADIATION HEATER

FIELD OF INVENTION

This invention relates to pyrolytic boron nitride heating devices and more particularly to a pyrolytic boron nitride radiation heater.

BACKGROUND OF THE INVENTION

A pyrolytic boron nitride heating unit includes a dielectric body of boron nitride and a heating element contained within the boron nitride body. The heating element is composed of a conductive material preferably of graphite and more particularly pyrolytic graphite. A pyrolytic boron nitride heating unit may be fabricated by depositing a layer of a conductive heating material over a substrate of pyrolytic boron nitride over which is deposited an outer layer of pyrolytic boron nitride as taught in U.S. Pat. No. 5,343,022 the disclosure of which is herein incorporated by reference. The outer layer of pyrolytic boron nitride electrically insulates the surface of the heating element and provides protection to the heating element from mechanical damage.

The heating element is connected to a power supply causing electricity to pass through the conductive material which, in turn, generates thermal energy by resistive heating. In most applications heat transfer is accomplished by conduction when the member or device to be heated is placed in physical contact with the heating element. It is, however, not always practical or even possible to establish physical contact between the heating element and the device or member to be heated. In these instances heat transfer must be accomplished by either convection or radiation. One example in which neither conduction or convection may be used for heat transfer is in molecular beam epitaxy "MBE" which is a process useful for growing semiconductor films. In this process the semiconductor film is grown in a relatively high vacuum environment where heat transfer by convection is not possible and heat transfer by conduction is not practical. Accordingly, in this application, which is only one of many, radiation is the only available heat transfer mechanism.

The efficiency of the heating unit to transmit thermal energy by radiation is directly proportional to the emissivity of the heating element in the heating unit. The emissivity of the heating element is defined as the ratio of the emissive power of an actual surface of the heating element to the emissive power of an ideal black body at the same temperature. The emissivity of commercially available pyrolytic boron nitride heating units has been measured at 0.55 at a wavelength of 1.55 microns. For purposes of comparison an ideal black body at the same wavelength would have a radiation thermal efficiency of 100% representing a measurement of 1.00. Accordingly, commercially available pyrolytic boron nitride heating units are not very efficient for use as radiant heaters.

SUMMARY OF THE INVENTION

A pyrolytic boron nitride radiation heating unit has been developed in accordance with the present invention having a radiation efficiency above 80% and preferably above at least 85%. The pyrolytic boron nitride radiation heating unit of the present invention comprises a dielectric base of boron nitride, a heating element of pyrolytic graphite superimposed on the dielectric base, with the heating element having a geometry forming a pair of contact ends, a first outer coating surrounding said heating element composed of pyrolytic boron nitride and a second outer coating surrounding said first outer coating with said second outer coating selected from the group consisting of silicon carbide and boron carbide with said contact ends of said heating element extending through said first and second outer coating for forming contact terminals for said heating unit.

BRIEF DESCRIPTION OF THE DRAWINGS

Other advantages of the present invention will become apparent from the following detailed description of the invention when read in conjunction with the accompanying drawings of which.

DETAILED DESCRIPTION OF THE INVENTION

Figure 1:
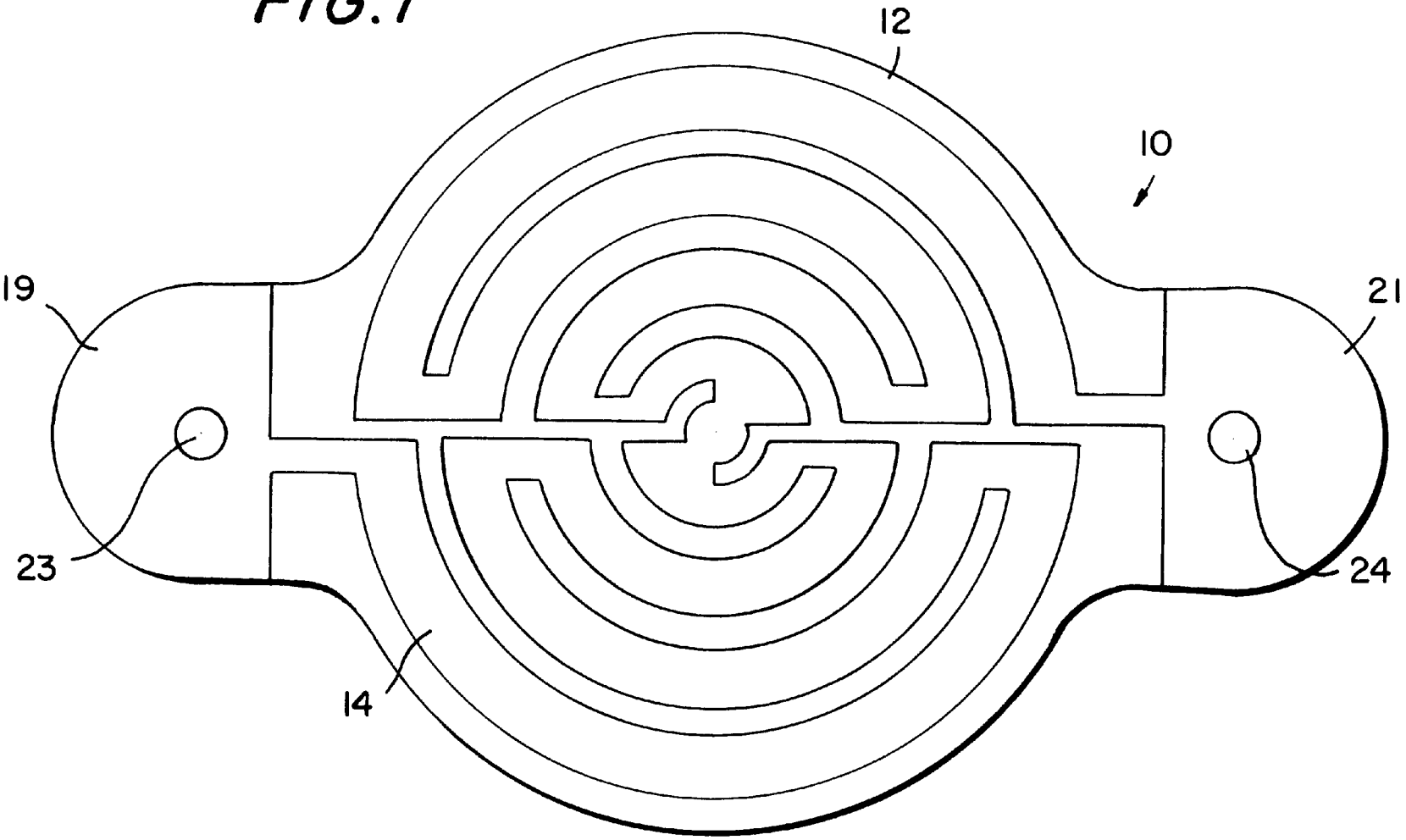
FIG. 1 is a plan view of the pyrolytic boron nitride heating unit of the present invention with the upper layers removed to expose the pyrolytic graphite heating element.
Figure 2A:
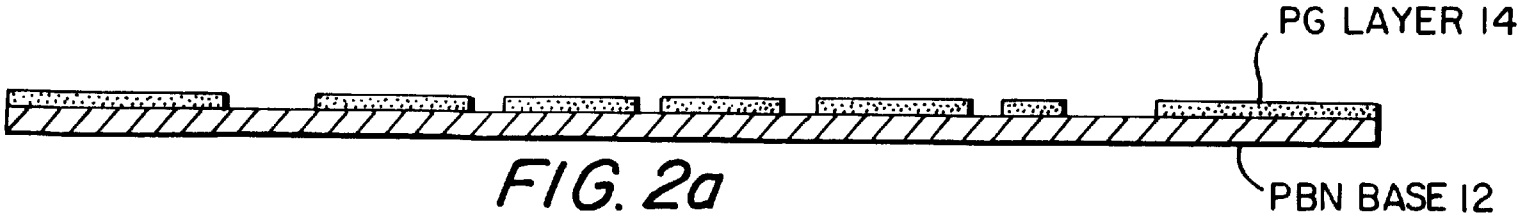
FIGS. 2(*a*)–(*c*) are side views in elevation taken along the lines 2—2 of FIG. 2 showing each of the process steps used in forming the pyrolytic boron nitride heating unit of FIG. 1.
Figure 2B:
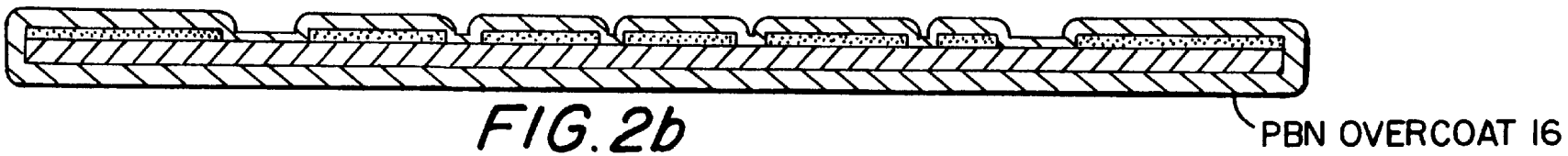
Figure 2C:
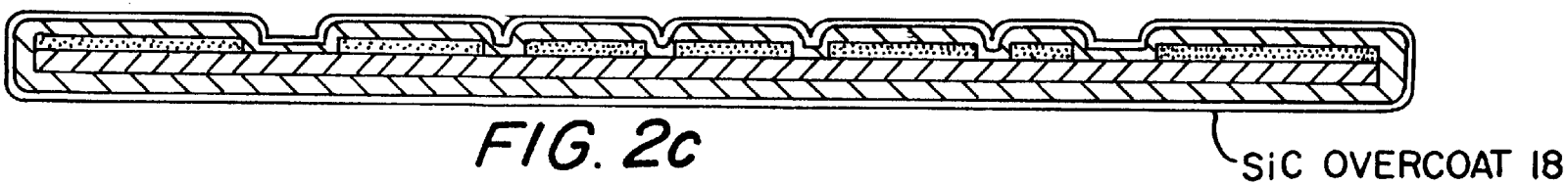

The pyrolytic boron nitride heating unit 10 of the present invention as shown in FIGS. 1 and 2 (*a*–*c*) inclusive comprises a pyrolytic boron nitride base plate 12, a coated layer of pyrolytic graphite 14, a first overcoat layer of pyrolytic boron nitride 16 and a second overcoat layer of either silicon carbide or boron carbide 18. Pyrolytic boron nitride (PBN) is formed by chemical vapor deposition of boron nitride in a reactor chamber by the vapor phase reaction of ammonia and a boron containing gas such as boron trichloride ($BCl_3$) as more specifically described in U.S. Pat. No. 3,152,006. The pyrolytic boron nitride when separated from the substrate forms a self standing article of purified pyrolytic boron nitride. The thickness of the pyrolytic boron nitride base plate 12 is not critical to the subject invention. The base plate 12 may be configured into any desired geometry. In FIG. 1 the base plate 12 is configured into a substantially circular geometry with two tabular ends 19 and 21 respectively.

The pyrolytic graphite layer 14 is coated directly over the base plate 12 and forms the heating element in the pyrolytic boron nitride heating unit 10 upon connection to an external power supply (not shown). Although any conductive material can be used graphite and more particularly pyrolytic graphite is preferred. Pyrolytic graphite may be formed by chemical vapor deposition of, for example, methane gas at a very high temperature in a reactor chamber with a suitable inert diluent. The coating of pyrolytic graphite 14 is machined into a desired configuration to maximize the generation of heat. The pyrolytic graphite 14 conductor is machined into a continuous strip preferably forming a spiral or serpendine geometry extending from one tabular end 19 to the other tabular end 21 of the heating unit 10. The external power supply (not shown) is connected between the two tabular ends 19 and 21 preferably by piercing each of the tabular ends 19 and 21 to form holes 23 and 24 over which the pyrolytic graphite layer 14 is formed. The holes 23 and 24 are masked during the formation of the first and second overcoat layers 16 and 18 respectively so to provide access to the machined strip of pyrolytic graphite 14 through the holes 23 and 24.

The first overcoat layer of pyrolytic boron nitride 16 is formed by chemical vapor deposition similar to the formation of the base plate 12 and encloses the pyrolytic graphite layer 14 except for the connections at the tabular ends 19 and 21. The first coating insulates and protects the conductive layer 14 from mechanical damage. A second outercoating 18 of silicon carbide or boron carbide is formed over the entire body except for the connections at the tabular ends 19 and 21. The second outercoating 18 may also be formed by chemical vapor deposition. The second outercoating 18 enhances the emissivity of the heating unit 10 for use as a radiation heater. With a coating of silicon carbide the emissivity of the heating unit 10 has been measured at 0.92 for a wavelength of 1.55. It is believed that a coating of boron carbide will also provide a significant emissivity somewhat comparable to the emissivity of silicon carbide and sufficient to provide a radiation efficiency of above at least about 80% and preferably above 85%. When the heating unit 10 is provided with an outer overcoat 18 with an emissivity such that the radiation efficiency is above 80% the rate of heat transfer is increased. This reduces the preheating time for heating a substrate.

What I claim is:

1. A pyrolytic boron nitride radiation heating unit comprising a dielectric base of boron nitride, a heating element of pyrolytic graphite superimposed on the dielectric base, a first outer coating surrounding said heating element composed of pyrolytic boron nitride for electrically isolating said heating element in said heating unit and a second outer coating surrounding said first outer pyrolytic boron nitride coating composed of a composition selected from the group consisting of silicon carbide and boron carbide wherein the radiation efficiency of said heating unit is above at least about 80% at a wave length of 1.55 microns with said heating element arranged in a predetermined geometry terminating in a pair of contact ends extending through said first and second outer coating for forming contact terminals adapted to electrically connect the heating element of said heating unit to an external source of electrical power.

2. A pyrolytic boron nitride radiation heating unit as defined in claim 1 wherein said second outer coating is silicon carbide with the emmissivity of said heating unit being above about 0.9 at a wave length of 1.55 microns.

* * * * *